US009379471B2

(12) United States Patent
Lee et al.

(10) Patent No.: US 9,379,471 B2
(45) Date of Patent: Jun. 28, 2016

(54) CONNECTOR FOR CAVITY FILTER

(71) Applicants: Dongguan ACE Technologies Corp., Dongguan (CN); Ace Technologies Corp., Incheon (KR)

(72) Inventors: Seungheon Lee, Dongguan (CN); Byungsung Kim, Dongguan (CN); Jonghwa Kim, Dongguan (CN)

(73) Assignee: DONGGUAN ACE TECHNOLOGIES CORP., Dongguan, Guangdong (CN)

( * ) Notice: Subject to any disclaimer, the term of this patent is extended or adjusted under 35 U.S.C. 154(b) by 0 days.

(21) Appl. No.: 14/837,213

(22) Filed: Aug. 27, 2015

(65) Prior Publication Data

US 2015/0364849 A1 Dec. 17, 2015

(30) Foreign Application Priority Data

Jun. 18, 2015 (CN) ..... 2015 2 0425370 U

(51) Int. Cl.

| | |
|---|---|
| ***H01R 13/40*** | (2006.01) |
| ***H01R 13/405*** | (2006.01) |
| ***H01R 4/02*** | (2006.01) |
| *H01P 1/205* | (2006.01) |

(52) U.S. Cl.

CPC ..... *H01R 13/405* (2013.01); *H01R 4/023* (2013.01); *H01P 1/2053* (2013.01)

(58) Field of Classification Search

CPC ..... H01R 13/40; H01R 13/405; H01R 13/42; H01R 13/426; H01R 13/4361

See application file for complete search history.

(56) References Cited

U.S. PATENT DOCUMENTS

| | | | | | |
|---|---|---|---|---|---|
| 2,410,618 | A * | 11/1946 | Zelov | H01R 24/22 | 174/51 |
| 4,035,045 | A * | 7/1977 | Trevithick | H01R 13/648 | 439/101 |
| 4,861,286 | A * | 8/1989 | Fosnaugh | H01R 13/719 | 439/620.08 |
| 5,423,692 | A * | 6/1995 | Francis | H01R 13/213 | 439/335 |
| 5,487,677 | A * | 1/1996 | Hoffner | H01R 13/28 | 439/293 |
| 6,514,106 | B2 * | 2/2003 | Peck | H01B 17/26 | 439/347 |
| 7,029,303 | B2 * | 4/2006 | Bordeau | H01R 13/187 | 439/286 |
| 7,695,333 | B2 * | 4/2010 | Strickland, Jr. | H01R 13/5221 | 439/737 |
| 7,854,629 | B1 * | 12/2010 | Albers | E21B 17/023 | 439/271 |
| 8,858,258 | B2 * | 10/2014 | Stokowski | H01R 13/42 | 439/582 |
| 2016/0093995 | A1 * | 3/2016 | Carbone | H01R 24/66 | 439/733.1 |

* cited by examiner

*Primary Examiner* — Gary Paumen
(74) *Attorney, Agent, or Firm* — Shimokaji IP

(57) ABSTRACT

A connector adapted for a cavity filter includes a housing, a contact pin, an insulating member, and a transmission line, the housing has a receiving space with a top opening and a side opening, a mounting hole is opened in a mounting base of the housing, the insulating member has a hollow structure and is fixedly configured in the housing, two connecting holes are opened in the contact pin, two positioning holes corresponding to the connecting hole are opened in the insulating member, a lower end of the contact pin is inserted into the top opening and through the insulating member, a positioning pin is inserted into the two connecting holes and the two positioning holes, and one end of the transmission line is inserted into the receiving space from the side opening and fixedly connected with the lower end of the contact pin.

8 Claims, 5 Drawing Sheets

CONNECTOR FOR CAVITY FILTER

RELATED APPLICATIONS

This application claims the benefit of priority to Chinese Patent Application No. 201520425370.X, filed on Jun. 18, 2015, which is hereby incorporated by reference in its entirety.

FIELD OF THE INVENTION

The present invention relates to a radio frequency communication technology, and more particularly to a connector for a cavity filter.

BACKGROUND OF THE INVENTION

Cavity filter serving as a frequency selection means is widely used in a field of communications, especially in a field of radio communications. In a base station, the cavity filter is used for selecting communication signals and filtering out clutters or interference signals beyond the frequency of the communication signals.

The cavity filter includes a cavity, a cover plate, a connector and a resonance tube, the cover plate is located on a top surface of the cavity, the cavity includes a cavity sidewall and several isolation ribs for isolating the cavity to a resonant cavity, and the connector is generally mounted on a side or a bottom of the cavity, sometimes is needed to be mounted on the top surface of the cavity.

As shown in FIG. 1*a*, 1*b* and 2, the connector is generally mounted on the top surface of the cavity in the following manner: firstly machining a mounting slot 20 in a top surface of the isolation ribs or a top surface of the cavity sidewall, the mounting slot 20 communicates with the resonant cavity, and then mounting the connector 21 in the mounting slot 20, welding an inner conductor 210 of the connector 21 to a cable 22, the cable 22 passes through the mounting slot 20 and enters into the resonant cavity, the cable 22 is welded to the resonance tube 23 in the resonant cavity so as to propagate signals between the inner conductor 210 of the connector 21 and the resonant cavity.

However, the conventional connector has the following disadvantages: (1) a mounting slot is needed for mounting the connector, which limits space thereof to a certain extent; (2) the connector has a decentralized structure, vibrations are easily generated between the components of the connector, and accumulated assembly tolerances would exist in assembly, the components thereof require multiple welding points for connecting, thereby affecting communication quality; (3) high cost.

SUMMARY OF THE INVENTION

An objective of the present invention is to provide a connector adapted for a cavity filter having an integrated structure, which does not need mounting slot for mounting the connector, thereby simplifying mounting operations, improving communication quality and reducing costs.

To achieve the objective, a connector adapted for a cavity filter is provided, which includes a housing, a contact pin, an insulating member, a positioning pin, and a transmission line, the housing has a receiving space with a top opening and a side opening, a mounting base is formed by outwardly protruding from the top opening of the housing, a mounting hole is opened in the mounting base for fixing the housing, the insulating member has a hollow structure and is fixedly configured in the housing, a connecting hole is opened in the contact pin, two positioning holes corresponding to the connecting hole are opened in the insulating member, a lower end of the contact pin is inserted into the top opening and through the insulating member, an upper end of the contact pin is located outside the housing, the positioning pin is sequentially inserted through one of the two positioning holes, the connecting hole and the other of the two positioning holes so as to fix the contact pin and the insulating member, one end of the transmission line is inserted into the receiving space from the side opening and fixedly connected with the lower end of the contact pin, and the other end of the transmission line is adapted for connecting with a resonance tube of the cavity filter.

In comparison with the prior art, the connector adapted for a cavity filter includes a housing, a contact pin, an insulating member, a positioning pin and a transmission line, wherein the insulating member is fixedly configured in the housing, the contact pin and the insulating member are fixedly connected by the connecting hole, the positioning holes and the positioning pin, and the transmission line is inserted into the housing and fixedly connected with the lower end of the contact pin. The connector has an integrated structure because the various components of the connector are fixedly connected, and the connector can be fixedly mounted just by means of the mounting hole in the housing without providing mounting slot for the connector, thereby simplifying mounting operations, reducing costs, avoiding multiple welding points due to the integrated structure of the connector, and improving communication quality.

Preferably, the housing includes a first housing portion, a second housing portion and a cover, the first housing portion includes a first cylindrical body having a bottom wall and a second cylindrical body fixedly formed on the bottom wall and located outside the first cylindrical body, a first through-hole whose diameter is equal to the inner diameter of the second cylindrical body is opened in the bottom wall of the first cylindrical body corresponding to the second cylindrical body, the second housing portion includes a vertical cylindrical portion and a horizontal cylindrical portion configured on a side wall of the vertical cylindrical portion and communicating with the vertical cylindrical portion, an upper end of the vertical cylindrical portion fixedly sleeves the second cylindrical body, the cover closes a lower opening of the vertical cylindrical portion, and an opening of the a horizontal cylindrical portion that is far from the vertical cylindrical portion forms the side opening.

Preferably, the insulating member includes a cylinder accommodated in the first cylindrical body, a second through-hole that allows the contact pin to be inserted through is opened at the center of the cylinder and along the vertical axis thereof, a plurality of ribs are formed on an outside wall of an upper end of the cylinder, a plurality of slots corresponding to the ribs are configured on an inner wall of the first cylindrical body, and the ribs fixedly engages with the slots.

Preferably, the insulating member further includes a panel configured on a top of the cylinder, a third through-hole is opened in the panel at a position corresponding to the second through-hole, a recess whose inner diameter is larger than the inner diameter of the top opening is opened in the mounting base at a position corresponding to the top opening, and the panel is abutted against a bottom wall of the recess when the cylinder is accommodated in the first cylindrical body.

Preferably, the connector adapted for a cavity filter further includes a protective sleeve, and the protective sleeve is put on both the horizontal cylindrical portion and part of the transmission line.

Preferably, the type of the protective sleeve is HST.

Preferably, the connector adapted for a cavity filter further includes a U-shaped insulating member, and the U-shaped insulating member is accommodated in the housing and contacts with the transmission line and the contact pin.

Preferably, the transmission line and the contact pin are fixed by welding.

The present invention will become more apparent from the following detailed description when taken in conjunction with the accompanying drawings used to illustrate embodiments of the invention.

DETAILED DESCRIPTION OF ILLUSTRATED EMBODIMENTS

Figure 1A:
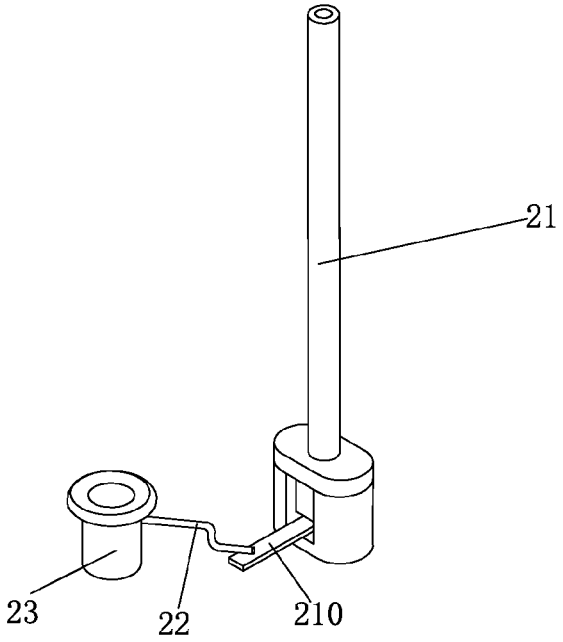
FIG. 1*a* is a perspective view of a conventional connector adapted for a cavity filter.
Figure 1B:
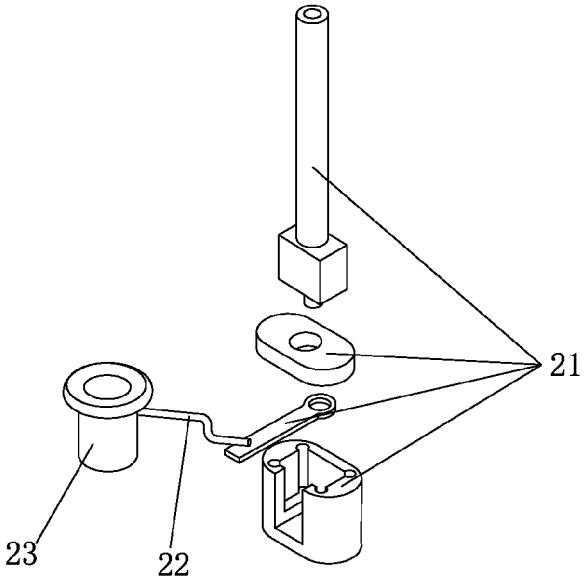
FIG. 1*b* is an exploded view of the connector in FIG. 1.
Figure 2:
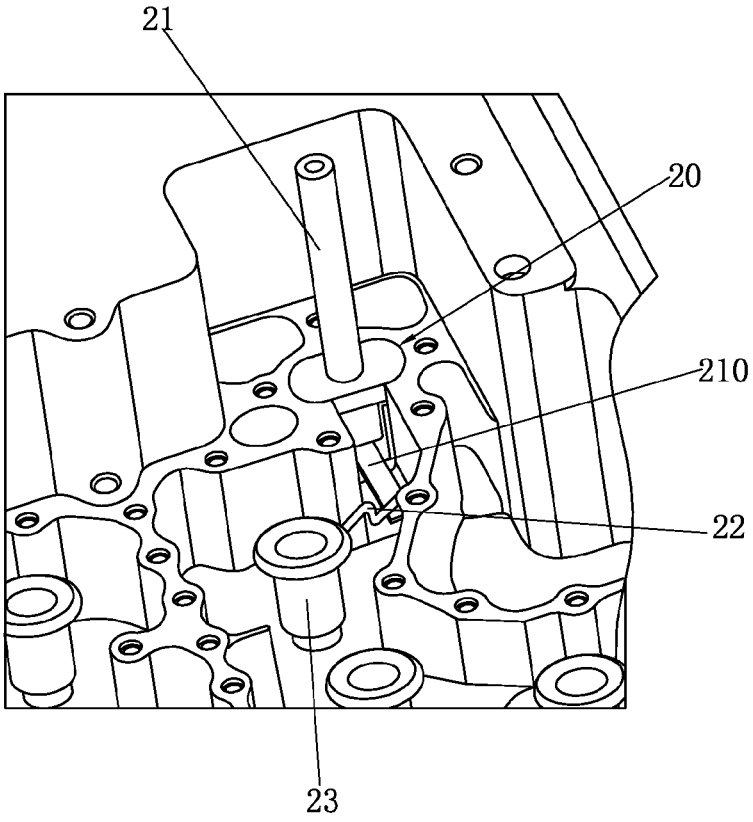
FIG. 2 is a perspective view of a conventional connector and a conventional cavity filter in assembly.
Figure 3:
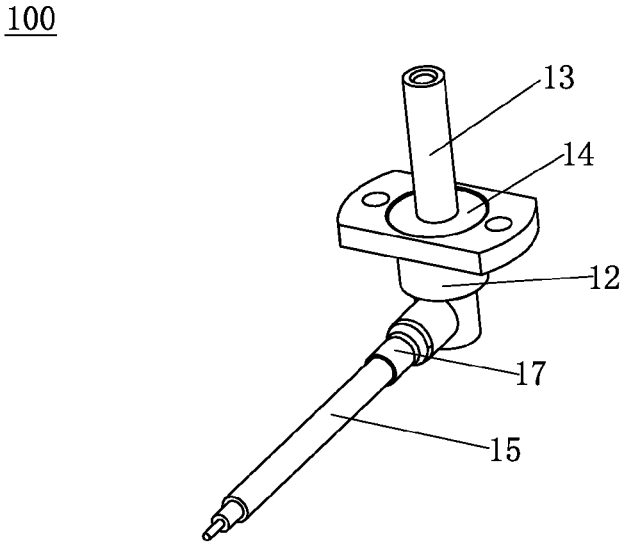
FIG. 3 is a perspective view of a connector adapted for a cavity filter of the present invention.

Preferred embodiments of the present invention will be described taking in conjunction with the accompanying drawings below, and a similar component label in drawings refers to a similar component.

Please refer to FIGS. 3 to 6, a connector 100 adapted for a cavity filter includes a housing 12, a contact pin 13, an insulating member 14, a transmission line 15 and a positioning pin 16, the housing 12 has a receiving space with a top opening A and a side opening B, a mounting base 121 is formed by outwardly protruding from the top opening A of the housing 12, at least one mounting hole(s) 123 is(are) opened in the mounting base 121 for fixing the housing 12, the insulating member 14 has a hollow structure and is fixedly configured in the housing 12, a connecting hole 131 is opened in the contact pin 13, two positioning holes 141 corresponding to the connecting hole 131 are opened in the insulating member 14, a lower end of the contact pin 13 is inserted into the top opening A and through the insulating member 14, the positioning pin 16 is sequentially inserted through one of the two positioning holes (such as 141*a*), the connecting hole 131 and the other of the two positioning holes (141*b*) so as to fix the contact pin 13, one end of the transmission line 15 is inserted into the receiving space from the side opening B and fixedly connected with the lower end of the contact pin 13, and the other end of the transmission line 15 is adapted for connecting with a resonance tube of the cavity filter.

In comparison with the prior art, the connector 100 adapted for a cavity filter has an integrated structure, and the connector 100 can be fixedly mounted just by means of the mounting hole 123 in the housing 12 without providing mounting slot for the connector 100, thereby simplifying mounting operations and reducing costs, meanwhile the integrated structure of the connector provides stable connection, avoids assembly tolerances and multiple welding points, and improves communication quality.

Figure 4:
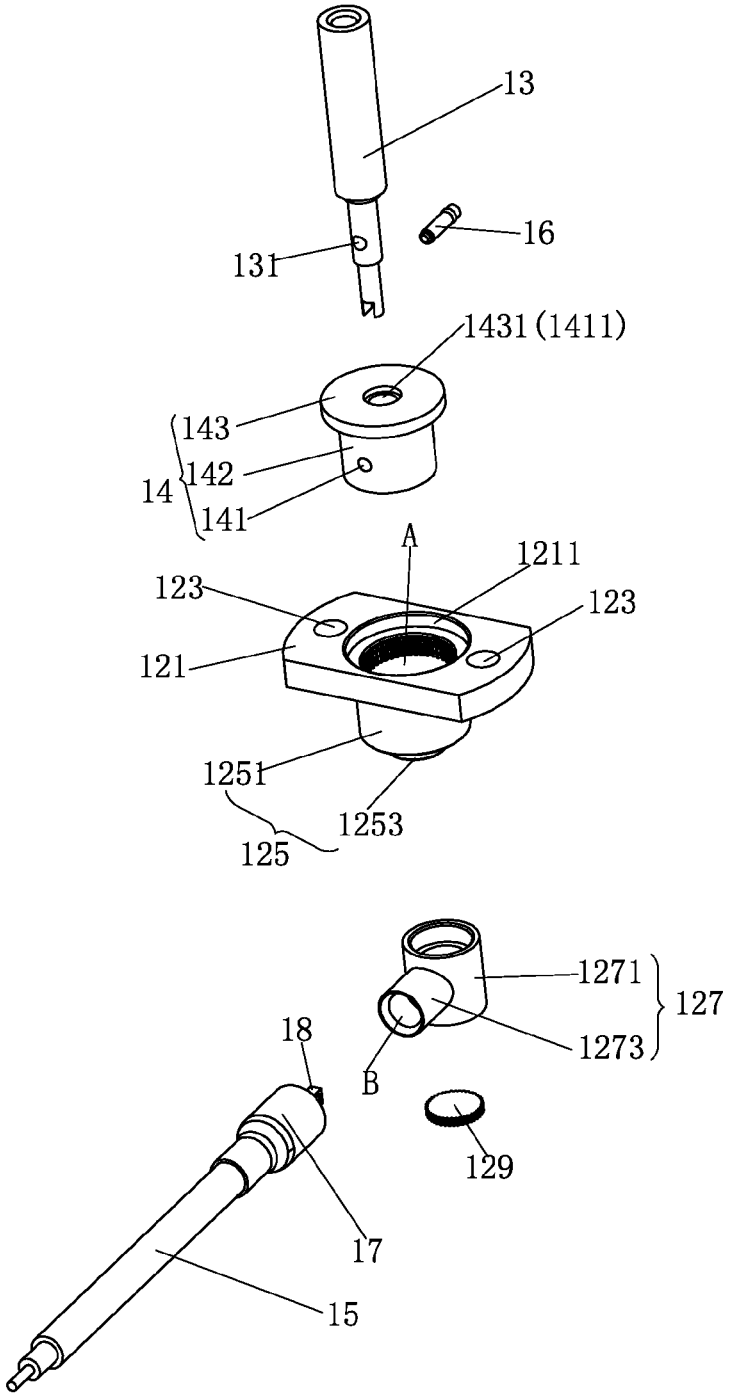
FIG. 4 is an exploded view of the connector adapted for a cavity filter in FIG. 3.
Figure 5:
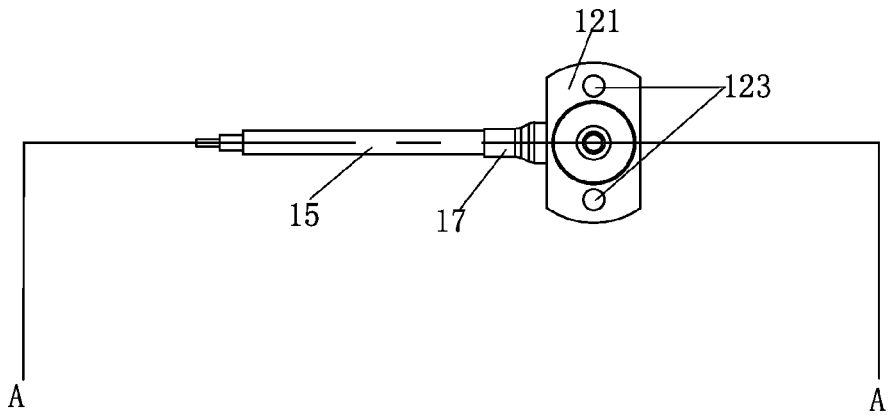
FIG. 5 is a top view of a connector adapted for a cavity filter of the present invention.
Figure 6:
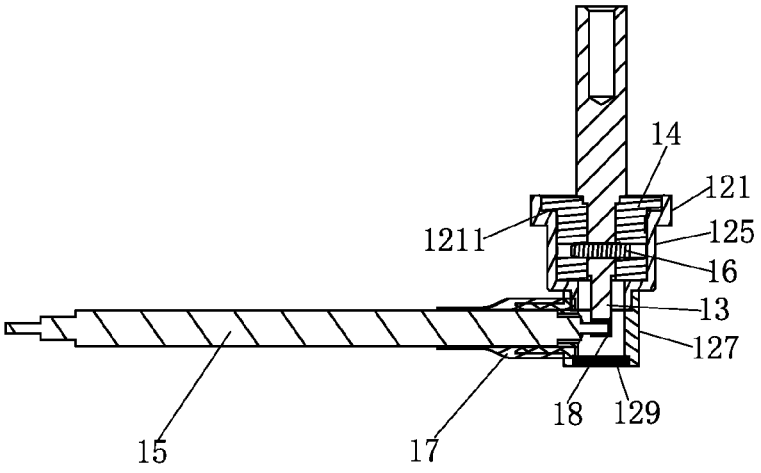
FIG. 6 is a sectional view of a connector adapted for a cavity filter along the A-A line in FIG. 5.

Concretely, as shown in FIG. 4, the housing 12 includes a first housing portion 125, a second housing portion 127 and a cover 129, the first housing portion 125 includes a first cylindrical body 1251 having a bottom wall and a second cylindrical body 1253 fixedly formed on the bottom wall and located outside the first cylindrical body 1251, and a first through-hole (not shown) whose diameter is equal to the inner diameter of the second cylindrical body 1253 is opened in the bottom wall of the first cylindrical body 1251 corresponding to the second cylindrical body 1253, which allows the contact pin 13 to be inserted through. The second housing portion 127 includes a vertical cylindrical portion 1271 and a horizontal cylindrical portion 1273 configured on a side wall of the vertical cylindrical portion 1271 and communicating with the vertical cylindrical portion 1271, an upper end of the vertical cylindrical portion 1271 fixedly sleeves the second cylindrical body 1253, the cover 129 closes a lower opening of the vertical cylindrical portion 1271, and an opening of the a horizontal cylindrical portion 1273 forms the side opening B. Wherein the concrete structure of the cover 129 and the lower end of the vertical cylindrical portion 1271 will be described below: a plurality of equally spaced ribs are configured on the side wall of the cover 129, a plurality of equally spaced slots corresponding to the ribs of the cover 129 are opened in the inner wall of the lower end of the vertical cylindrical portion 1271, and the ribs engages with the slots so as to fixedly connect the cover 129 and the vertical cylindrical portion 1271. Referring to FIG. 4, the insulating member 14 includes a cylinder 142 accommodated in the first cylindrical body 1251 and a panel 143 configured on a top of the cylinder 142, a second through-hole 1411 that allows the contact pin 13 to be inserted through is opened at the center of the cylinder 142 and along the vertical axis thereof, a third through-hole 1431 is opened in the panel 143 at a position corresponding to the second through-hole 1411, a plurality of ribs are formed on an outside wall of an upper end of the cylinder 142, a plurality of slots corresponding to the ribs are configured on an inner wall of the first cylindrical body 1251, and the ribs fixedly engages with the slots so as to fixedly connect the cylinder 142 and the first cylindrical body 1251. A recess 1211 whose inner diameter is larger than the inner diameter of the top opening A is opened in the mounting base 121 at a position corresponding to the top opening A, and the panel 143 is abutted against a bottom wall of the recess 1211 when the cylinder 142 is accommodated in the first cylindrical body 1251.

In addition, as shown in FIGS. 3 to 6, the connector 100 further includes a protective sleeve 17 and a U-shaped insulating member 18, the protective sleeve 17 is put on both the horizontal cylindrical portion 1273 and part of the transmission line 15, the U-shaped insulating member 18 is accommodated in the housing 12 and contacts with the transmission line 15 and the contact pin 13. Preferably, the type of the protective sleeve is HST. Additionally, the transmission line 15 and the contact pin 13 are fixed by welding.

Figure 7:
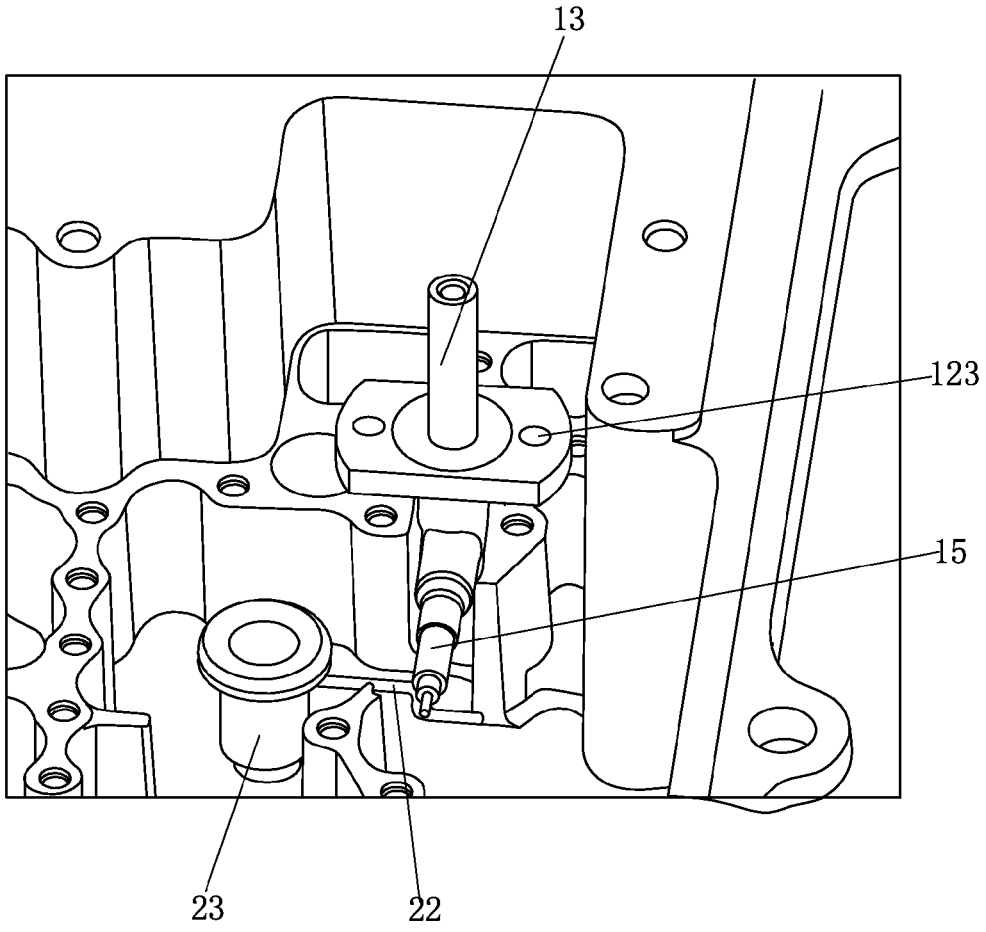
FIG. 7 is a perspective view of a connector adapted for a cavity filter and a cavity filter in assembly of the present invention.

Referring to FIG. 7, it is a perspective view of the connector 100 of the present invention in assembly, as shown in FIG. 7, the connector 100 is mounted on a top surface of the cavity by means of the two mounting holes 123, and then the transmission line 15 is connected to a resonance tube 23 by a cable 22, and the connector 100 can be mounted without mounting slot. In addition, the connector 100 has an integrated structure, which simplifies mounting operations.

While the present invention has been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention.

What is claimed is:

1. A connector adapted for a cavity filter, comprising a housing, a contact pin, an insulating member, a positioning pin, and a transmission line, the housing having a receiving space with a top opening and a side opening, a mounting base being formed by outwardly protruding from the top opening of the housing, a mounting hole being opened in the mounting base for fixing the housing, the insulating member having a hollow structure and being fixedly configured in the housing, a connecting hole being opened in the contact pin, two positioning holes corresponding to the connecting hole being opened in the insulating member, a lower end of the contact pin being inserted into the top opening and through the insulating member, an upper end of the contact pin being located outside the housing, the positioning pin being sequentially inserted through one of the two positioning holes, the connecting hole and the other of the two positioning holes so as to fix the contact pin and the insulating member, one end of the transmission line being inserted into the receiving space from the side opening and fixedly connected with the lower end of the contact pin, and the other end of the transmission line being adapted for connecting with a resonance tube of the cavity filter.

2. The connector adapted for a cavity filter according to claim 1, wherein the housing comprises a first housing portion, a second housing portion and a cover, the first housing portion comprises a first cylindrical body having a bottom wall and a second cylindrical body fixedly formed on the bottom wall and located outside the first cylindrical body, a first through-hole whose diameter is equal to the inner diameter of the second cylindrical body is opened in the bottom wall of the first cylindrical body corresponding to the second cylindrical body, the second housing portion comprises a vertical cylindrical portion and a horizontal cylindrical portion configured on a side wall of the vertical cylindrical portion and communicating with the vertical cylindrical portion, an upper end of the vertical cylindrical portion fixedly sleeves the second cylindrical body, the cover closes a lower opening of the vertical cylindrical portion, and an opening of the a horizontal cylindrical portion that is far from the vertical cylindrical portion forms the side opening.

3. The connector adapted for a cavity filter according to claim 2, wherein the insulating member comprises a cylinder accommodated in the first cylindrical body, a second through-hole that allows the contact pin to be inserted through is opened at the center of the cylinder and along the vertical axis thereof, a plurality of ribs are formed on an outside wall of an upper end of the cylinder, a plurality of slots corresponding to the ribs are configured on an inner wall of the first cylindrical body, and the ribs fixedly engages with the slots.

4. The connector adapted for a cavity filter according to claim 3, wherein the insulating member further comprises a panel configured on a top of the cylinder, a third through-hole is opened in the panel at a position corresponding to the second through-hole, a recess whose inner diameter is larger than the inner diameter of the top opening is opened in the mounting base at a position corresponding to the top opening, and the panel is abutted against a bottom wall of the recess when the cylinder is accommodated in the first cylindrical body.

5. The connector adapted for a cavity filter according to claim 2, further comprising a protective sleeve, and the protective sleeve being put on both the horizontal cylindrical portion and part of the transmission line.

6. The connector adapted for a cavity filter according to claim 5, wherein the type of the protective sleeve is HST.

7. The connector adapted for a cavity filter according to claim 1, further comprising a U-shaped insulating member, and the U-shaped insulating member being accommodated in the housing and contacting with the transmission line and the contact pin.

8. The connector adapted for a cavity filter according to claim 1, wherein the transmission line and the contact pin are fixed by welding.

* * * * *